US012036438B2

(12) United States Patent
Rios Ocasio

(10) Patent No.: US 12,036,438 B2
(45) Date of Patent: Jul. 16, 2024

(54) SURFACE-EMPATHIC EXERCISE BENCH

(71) Applicant: RIOS DEL VALLE LLC, San Juan, PR (US)

(72) Inventor: Cristian Sebastian Rios Ocasio, San Juan, PR (US)

( * ) Notice: Subject to any disclaimer, the term of this patent is extended or adjusted under 35 U.S.C. 154(b) by 0 days.

(21) Appl. No.: 17/226,015

(22) Filed: Apr. 8, 2021

(65) Prior Publication Data

US 2021/0316183 A1 Oct. 14, 2021

Related U.S. Application Data

(60) Provisional application No. 63/006,815, filed on Apr. 8, 2020.

(51) Int. Cl.
*A63B 21/00* (2006.01)

(52) U.S. Cl.
CPC ..... *A63B 21/4029* (2015.10); *A63B 2225/09* (2013.01)

(58) Field of Classification Search
CPC ..... A63B 21/4029; A63B 2225/09; A63B 2071/0694; A63B 21/4039
See application file for complete search history.

(56) References Cited

U.S. PATENT DOCUMENTS 4,621,809 A * 11/1986 Pearl ..... A63B 21/4029 482/104
5,348,523 A * 9/1994 Blount ..... A63B 21/078 5/652
5,830,113 A * 11/1998 Coody ..... A63B 21/4029 482/54
6,015,370 A * 1/2000 Pandozy ..... A63B 23/0233 482/142
6,899,662 B2 * 5/2005 Gamble ..... A63B 21/4039 482/142
9,526,939 B2 * 12/2016 Longfellow ..... A63B 21/068
9,545,540 B1 * 1/2017 Moschel ..... A63B 21/0724
10,029,141 B2 * 7/2018 Lagree ..... A63B 21/4033
10,589,144 B2 * 3/2020 Specht ..... A63B 21/4029
10,925,793 B2 * 2/2021 Sepulveda ..... A61H 1/005
2003/0050157 A1 * 3/2003 Teuscher ..... A63B 21/00 482/142
2004/0214692 A1 * 10/2004 Koenig ..... A63B 21/4037 482/909
2004/0220028 A1 * 11/2004 Gamble ..... A63B 21/00047 482/142

(Continued)

FOREIGN PATENT DOCUMENTS

KR 101306477 B1 * 3/2012 ..... A47C 7/002

*Primary Examiner* — Andrew S Lo
*Assistant Examiner* — Andrew M Kobylarz
(74) *Attorney, Agent, or Firm* — Eugenio J. Torres-Oyola; Victor M. Rodriguez-Reyes; Rafael Rodriguez-Muriel

(57) ABSTRACT

The present disclosure is directed to an exercise bench device that provides surface empathy between a user's body and the bench's platforms. The device comprises strategically placed cushions that feature the shape of a human spine, neck, legs and buttocks. Said cushions comprise indicia that allow a user to know where exactly each part of the body should be located when exercising in order to prevent injuries. The device further comprises an adjustable set of platforms where said cushions are located, in order to allow use by different types of users.

12 Claims, 4 Drawing Sheets

(56) References Cited

U.S. PATENT DOCUMENTS

| | | | | |
|---|---|---|---|---|
| 2007/0155604 | A1* | 7/2007 | Hockemeyer | A63B 21/078 482/142 |
| 2007/0225138 | A1* | 9/2007 | Mednick | A63B 23/0216 482/148 |
| 2008/0203776 | A1* | 8/2008 | Mongelluzzo | A63B 21/16 297/118 |
| 2009/0188047 | A1* | 7/2009 | Morse | A61H 1/0292 5/655.9 |
| 2009/0253556 | A1* | 10/2009 | Chaplik | A63B 21/4037 482/23 |
| 2011/0065554 | A1* | 3/2011 | Van Straaten | A63B 21/4029 482/130 |
| 2011/0224059 | A1* | 9/2011 | Crawley | A63B 21/4029 482/142 |
| 2013/0253582 | A1* | 9/2013 | Tielve | A61H 1/0292 606/240 |
| 2014/0141942 | A1* | 5/2014 | Ford | A63B 71/0054 482/93 |
| 2014/0243175 | A1* | 8/2014 | Huang | A63B 23/0216 482/142 |
| 2014/0342888 | A1* | 11/2014 | Cecil | A63B 21/4039 482/142 |
| 2015/0364058 | A1* | 12/2015 | Lagree | G09B 19/0038 434/257 |
| 2018/0099176 | A1* | 4/2018 | Specht | A63B 21/4029 |
| 2021/0316183 | A1* | 10/2021 | Rios Ocasio | A63B 21/4029 |

* cited by examiner

SURFACE-EMPATHIC EXERCISE BENCH

RELATED APPLICATIONS

This application claims priority from U.S. Provisional Application 63/006,815, filed on Apr. 8, 2020, which the contents of which are fully incorporated by reference.

STATEMENT REGARDING FEDERALLY SPONSORED RESEARCH AND DEVELOPMENT

N/A

BACKGROUND OF THE INVENTION

Field of the Invention

The present invention is generally directed to an exercise bench, and more particularly, to an apparatus comprising cushions strategically placed for providing support to relevant parts of the human body. The present invention is relevant to the evolution of gym furniture and the ergonomic considerations of the human posture. This disclosure shows how undulated surfaces are more suitable for the human skeletal system and the preferred design for reducing the risk of injuries in gym furniture and equipment.

Discussion of the Background

There are some traditional customer profiles in gymnasiums: first there's the low self-motivated person interested in some degree of transformation (weight loss, muscular shape, flexibility, etc.) within the next eight months. The second group are the short-term goals achievers. They have a specific event or goal to accomplish within the next months, for which an intense routine, diet, and constant training are required. The third group are made up of the traditional athletes, or "gym rats", who have an athletic background or some sense of exercising structure. However, despite their chromatic high energy and adrenaline, a closer look shows that there are some problems. Most of them use an incorrect posture or alignment. The human body contains axis lines that divide the unit of the body in planes.

Lowering the shoulders, flattening the lower back, or to relaxing the neck are examples of reminders that trainers need to give people at gyms. There's a degree of disconnection between themselves and the mechanics of those movements in relation to possible injuries. The science of working out and the implications of an incorrect posture on the human anatomy are presumed knowledge that one has while exercising, but that is not always the case. In fact, the only existing solution to mitigate this dilemma is personal trainer services, and isolated efforts for cushioning certain parts of the body. However, these interventions are insufficient and not accessible to everyone.

The Cambridge Dictionary defines the term flat as "the quality of being level and without curves, high, or hollow parts". For instance, the gym bench is flat, the seats of the machines are flat, the back vests are flat, the bike pedals are flat. However, while we know that in other fields there is an appreciation of form, why can we not find a greater appreciation for form in gym furniture? Is flatness a given in the gym furniture industry? How is it that we can acknowledge an issue, but just ignore it?

It is true that the gym equipment reflects the manufacturing techniques from the time during which it was built, but they also embody the culture in which they were immersed and the priorities that shaped social contexts. Is the flatness of a gym bench evidence for a lack of attention as to the destined user anatomy? John Morley, in his book History of Furniture: Twenty-five centuries of style and design in the western tradition demonstrates how early Roman furniture was more concerned about aesthetics and embellishments than the functionality of the design. For Roland Barthes—due to cultural hegemony, collective usage, and structural association with a table—a gym bench is for sitting or lying down. The message in the usage is the significant. What is it for? Does the bench signify or welcome an object (or user) to sit or lay on it? Because the bench is designed to be used for fitness purposes and scenarios, it induces a signifier who will read what actions or meaning can be derived from it. And so, the surface of a bench should receive the surface of the user's back, in an empathetic dialectic where furniture and anatomy perfectly merge.

Our bones are interconnected different directions or orientations. There are six different sets of anatomical terms for direction in the human body: anterior or posterior; superior or inferior; medial or lateral; mesial or distal; buccal, labial, or lingual; and proximal or distal. Other relevant anatomical planes and directions are the anterior and posterior directions, which refer to the front and back of the body, or parallel to the front and back of the body. Such planes lie perpendicular to the axis of symmetry, which divides the body into right and left halves. The terms superior and inferior refer to the relative placement of structures along a vertical axis. And finally, proximal and distal refer to the relationship between the bones or other structures of the limbs.

Proper body mechanics paired with an understanding of the body posture can contribute to a healthier and more effective exercise experience.

A surface empathy between two objects can be found when the objects share a common surface design, generating some stable relation as a unit. An example of this is the relationship between the flat surface of a table and the flat bottom end part of a cup. Once these two flat surfaces meet, they establish a cohesive, effortless relationship in which both entities can rest on the other without no other tension involved.

On the other hand, surface discrepancy can be found when two surfaces from two or more different objects do not match in the shape. Once surface discrepancy happens, we can find empty/blank spaces in between the surfaces, in which assembly is not properly sealed. This discrepancy between surfaces generally generates some sort of tension, and any other external or internal force can easily break the point of encounter. A common example is a sphere (or any ball) on the ground. Since the ball has no flat face, or surface, it will not totally bond with the floor, which means that any internal or external force (like gravity or wind) can easily affect the point of encounter. This relationship, due the lack of stability, promotes tension and inaccuracy.

When we lift free-weights on a flat surface without 'proper' support, due to the load of weight involved while exercising and a poor core awareness, the body arches and contracts in ways and directions that can injure, especially the neck and back. The neck is susceptible to injury because it is capable of extensive range of motion. It is, as a result, less stable that many other body areas. In addition, the neck muscles are affected by the motion of nearly all other areas of the body.

The term "affordance discrepancy" states a lack of correlation between the physicality of a design (shape, size, contour, material selection) with the part of the body with which it is destined to interact.

Some solutions to the problem of flat exercise equipment exist in the prior art. For example, U.S. Pat. No. 7,153,249 discloses an exercise bench with a contour frame. In this application, the conflict between the two forces on a straight line was approached by adding another point(s) of tension between the two main ones. The result, is a "broken line," which is not a curve, like the human spine. A curve, as opposed to a broken line, is produced by the effect of two forces acting simultaneously. Further more, this design provides no neck cushioning.

U.S. Patent Application No. 20190262659A1 discloses a foam cushion to be added to traditional exercise benches. However, it is limited to an isolated item exclusively for the upper body. The cushioning points between the neck and the lower back are on a flat surface instead of being harmoniously integrated on one continuous curvature.

International Patent Application WO2012138336A1 discloses an exercise bench with a tillable bladder. This invention, however, is limited to one single unit and surface and does not provide length adjustment, angle articulation or a touch point with the knees (in relation with the tail bone). The surface is made one single compilation of rods that respond to the external pressure rather than an undulated cushioning units.

These examples of prior art do tackle some of the principles for cushioning during exercising on a bench-press, however none of them showcase the synthesis of the main cushioning points (neck, lower back, bone tail, and knee) combined into one single unit that also articulates (angle) and adjust to different sizes. Also, none of the surfaces from the case studies above demonstrate an undulated cushioning surface to promote an empathetic relationship between the user and the machine, for upper and lower body separately, integrated into one continuous undulated surface. Finally, none of the cited references above uses color, on the surface, for instructing the user about the right body placement on the machine, through the principle of body mapping.

Therefore, there is a need in the art for an exercise bench that features a continuous undulated surface for cushioning the different curvatures of the neck, lower-back, and legs, including a colored surface as an indicator to the user for the right placement through the use of body mapping, and angle and height adjustment.

SUMMARY OF THE INVENTION

The present invention is generally related to an exercise bench comprising two cushioned and adjustable platforms that allow for surface empathy between the bench and the body of the user, avoiding injuries and strain when exercising.

In a first aspect of the present invention, the exercise bench comprises cushions strategically located where the user's neck, middle/lower back, and knees are to be placed.

Another aspect of the present invention is that each cushion features indicia such as colors, words or symbols in order to indicate where the parts of the body should be placed on the bench to fully benefit from the shape of the cushions.

Another aspect of the present invention is that said invention provides for angular adjustment of the bench platforms, allowing for different types of bodies. The invention also allows for length adjustment.

The disclosure itself, both as to its configuration and its mode of operation will be best understood, and additional objects and advantages thereof will become apparent, by the following detailed description of a preferred embodiment taken in conjunction with the accompanying drawing.

The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The accompanying drawings, which are incorporated herein, constitute part of the specifications and illustrate the preferred embodiment of the invention.

DESCRIPTION OF THE PREFERRED EMBODIMENT

An exemplary embodiment of the present invention focuses on two different areas:

Surface ideation for body cushioning

The structure and mechanics of the furniture

Figure 1:
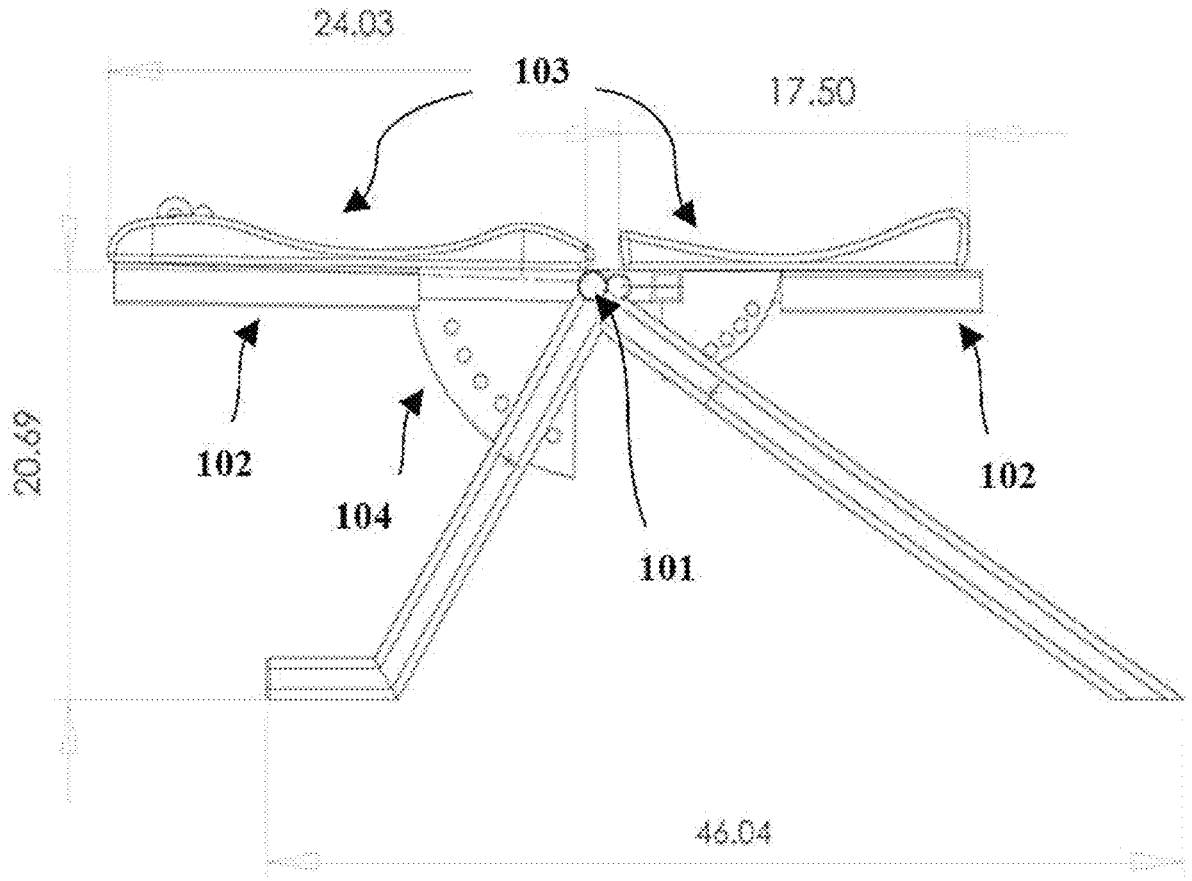
FIG. 1 shows an embodiment of the present invention in a flat position.
Figure 2:
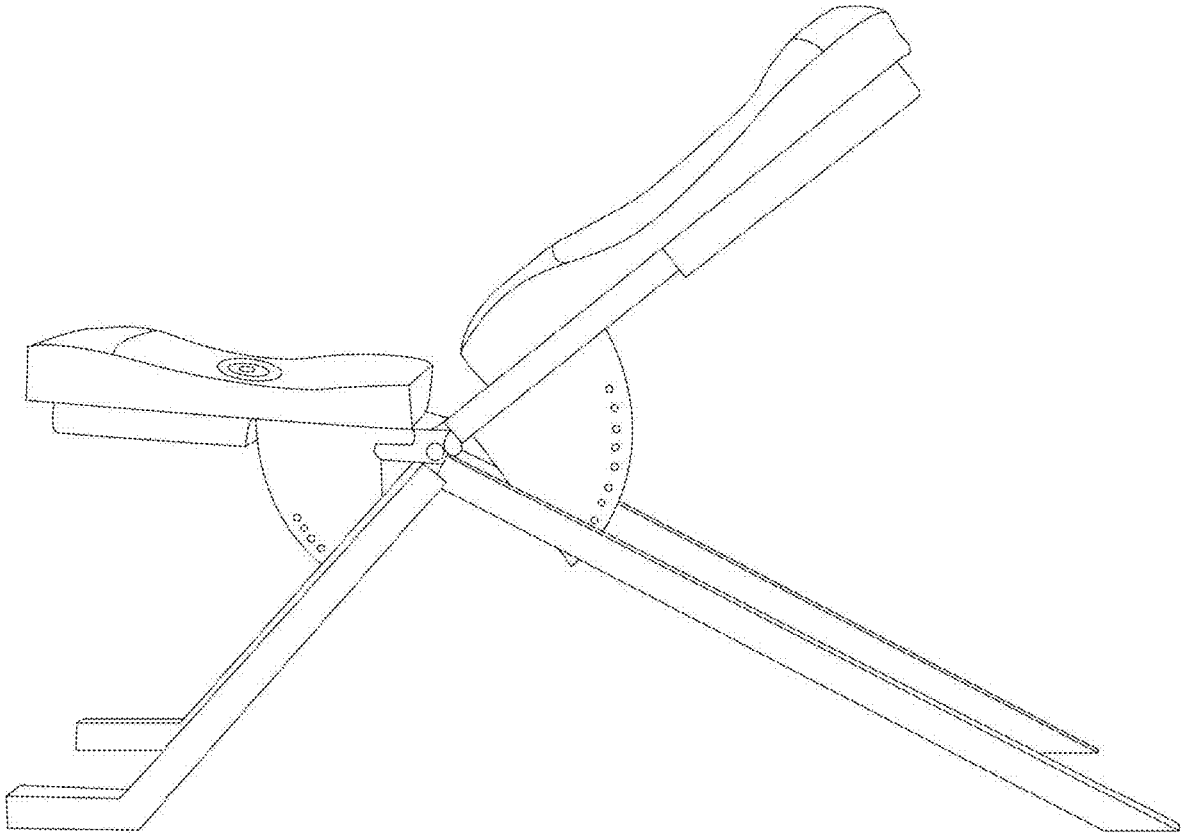
FIG. 2 shows an embodiment of the present invention in an angular position based on the body of a user.

As shown in FIG. 1, the exemplary embodiment comprises a steel tube 101 with two metal platforms 102 configured to place the different cushioning surfaces 103 on them, providing a user experience close to a regular bench-press. These components could be a ~1.5 square inch tube welded bar, which acts as a base, with two metal movable platforms on which the cushions may be placed. Said platforms comprise a fin-like protrusion 104 with holes, which allows the platform to be adjusted at different angles (FIG. 2), depending on the body type and requirements of the user. Underneath said two metal surfaces, at the bottom, they slide with the bar along the Y axis, allowing an easy adjustment for the user's legs and torso.

Figure 3:
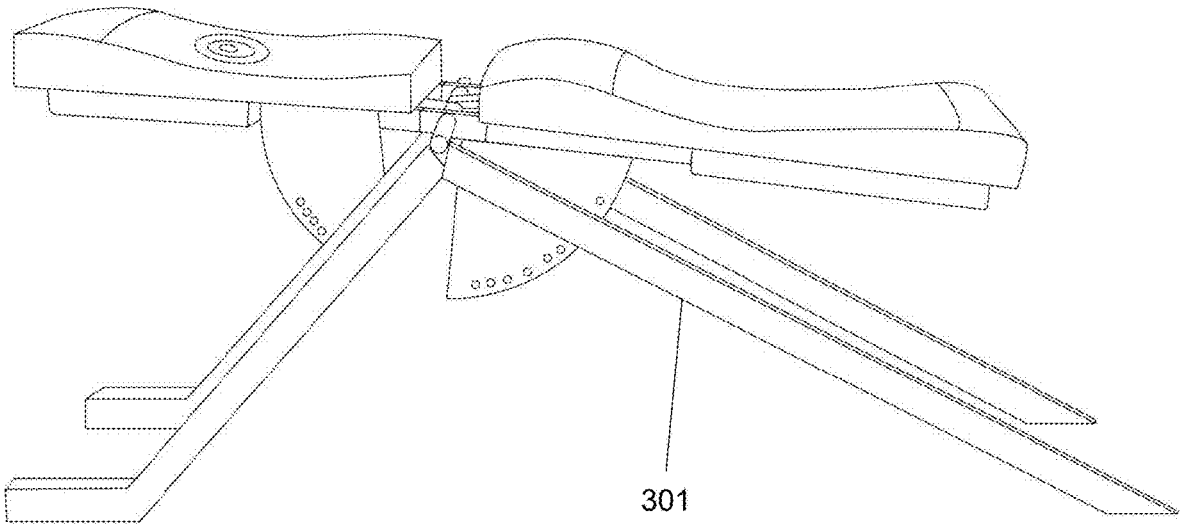
FIG. 3 shows an embodiment of the present invention, focusing on the angular base.

Said steel tube is welded onto an angular base 301 which properly supports the distributed weight of the user, as seen on FIG. 3. The proportions used for each component in relation to different bodies of different users, allow for a universal fitting that is not only visually pleasant, but also harmonious and functional. The measurements of the system are mainly understood as an extension and study of the human proportions.

The cushions to be placed on said metal platforms must avoid narrowed corners where germs could grow, which also allows for easier cleaning. The cushioning is essential for every user in order to distribute the pressure of the weight of the body at the point of interface, over a larger surface area. An overstuffed seating could provide discomfort, fatigue, and pain. The areas of greatest potential discomfort are located where the bone structures are closest to the skin due the compressive stress imposed on the body tissue.

The three main areas of the body (neck, middle/lower back, and knees) on which the cushioning is focused allows for lowered tension. This cushioning provides a more comfortable experience, and a higher engagement level with core muscles. An engaged core lowers risk for injuries and allows for more precise mechanics of movement during exercising.

Focusing on the importance of proper cushioning of areas like the coccyx, or buttocks homogenize a point for connection between the torso and the legs, which allows said metal platforms to integrate and work properly as a system.

Figure 4:
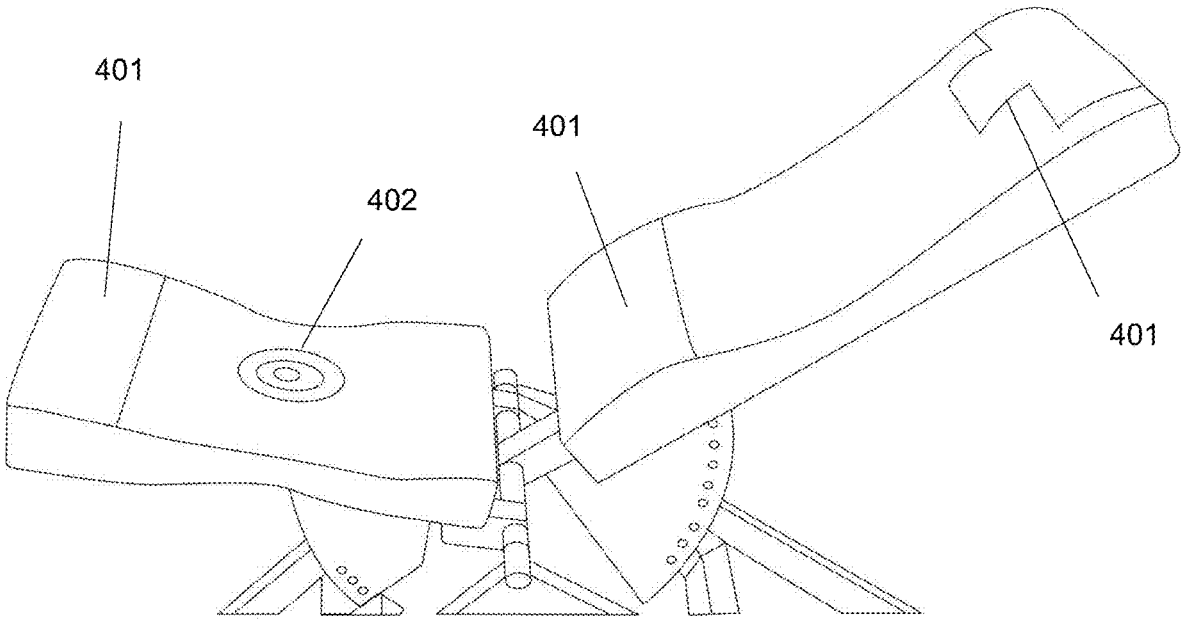
FIG. 4 shows the indicia located on the cushions according to the present disclosure.

FIG. 4 shows an exemplary embodiment of the present invention comprising indicia, such as color 401 or symbols 402 that allows the user to know where each relevant body part must be placed on the bench. In exemplary embodiments, the color scheme is inspired by the bones and energetic/dynamic warm colors, which helps users to understand where to position their body on the bench press, making the experience of exercising not only more fun and dynamic, but also allowing users to do so with more confidence. In other embodiments, such indicia may comprise of a bulls-eye or other symbol or words that allow for a fast visualization of the right place for sitting.

Although certain exemplary embodiments and methods have been described in some detail, for clarity of understanding and by way of example, it will be apparent from the foregoing disclosure to those skilled in the art that variations, modifications, changes, and adaptations of such embodiments and methods may be made without departing from the true spirit and scope of the claims. Therefore, the above description should not be taken as limiting the scope of the invention.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

The invention claimed is:

1. An exercise bench, comprising:

a bar;

a first movable platform;

a second movable platform;

a first undulated cushion and a second undulated cushion;

wherein the first undulated cushion is attached to and corresponds to the first movable platform;

wherein the second undulated cushion is attached to and corresponds to the second movable platform;

wherein the first undulated cushion includes a top area adapted to conform to the neck of a user, a middle area adapted to conform with the middle back of the user, and a bottom area adapted to conform with the lower back of the user;

wherein the top area and the bottom area of the first undulated cushion have a cushion thickness that is greater than a cushion thickness of the middle area;

wherein the second undulated cushion includes a rear area, a front area, and a middle area located between the front area and the rear area;

wherein the middle area is adapted to conform with the coccyx or buttocks of the user, and the front area is adapted to conform with the knees or lower legs of the user;

wherein the front area and the rear area of the second undulated cushion each have a cushion thickness and a surface area that is greater than a cushion thickness and surface area of the middle area;

wherein the top area of the first undulated cushion comprises a colored indicator for indicating placement of the neck of the user, and the bottom area of the first undulated cushion comprises a colored indicator for indicating placement the lower back of the user;

wherein the middle area of the second undulated cushion comprises a colored indicator for indicating placement of the coccyx or buttocks of the user, and the front area of the second cushion comprises a colored indicator for indicating placement of the knees or lower legs of the user;

wherein said first and second movable platforms each comprise a protrusion with a plurality of holes, each protrusion being configured to allow the corresponding movable platform to be adjusted to different angles;

wherein said first and second movable platforms are connected to said bar, forming an angle between said first and second movable platforms.

2. The exercise bench of claim 1, wherein said colored indicator for indicating placement of the user's neck, lower back, coccyx, buttocks, knees, or lower legs comprises at least one color that is different from a color of the first undulated cushion or the second undulated cushion.

3. The exercise bench of claim 1, wherein said colored indicator for indicating placement of the user's neck, lower back, coccyx, buttocks, knees, or lower legs comprises text.

4. The exercise bench of claim 1, wherein said colored indicator for indicating placement of the user's neck, lower back, coccyx, buttocks, knees, or lower legs comprises at least one symbol.

5. The exercise bench of claim 1, further comprising colored indicator on the first cushion for indicating placement of the user's middle back.

6. The exercise bench of claim 1, wherein said angle between said first and second movable platforms is adjustable.

7. The exercise bench of claim 1, wherein in the top area and the bottom area of the first undulated cushion have a surface area that is greater than a surface area of the middle area.

8. An exercise bench, comprising:

a bar;

a first movable platform;

a second movable platform;

a first undulated cushion and a second undulated cushion;

wherein the first undulated cushion is attached to and corresponds to the first movable platform;

wherein the second undulated cushion is attached to and corresponds to the second movable platform;

wherein the first undulated cushion includes a top area adapted to conform to the neck of a user, a middle area adapted to conform with the middle back of the user, and a bottom area adapted to conform with the lower back of the user;

wherein the top area and the bottom area of the first undulated cushion have a cushion thickness that is greater than a cushion thickness of the middle area;

wherein the second undulated cushion includes a rear area, a front area, and a middle area located between the front area and the rear area;

wherein the middle area is adapted to conform with the coccyx or buttocks of the user, and the front area is adapted to conform with the knees or lower legs of the user;

wherein the front area and the rear area of the second undulated cushion each have a cushion thickness and a surface area that is greater than a cushion thickness and surface area of the middle area; wherein the top area of the first undulated cushion comprises a colored indicator for indicating placement of the neck of the user, and the bottom area of the first undulated cushion comprises a colored indicator for indicating placement the lower back of the user; wherein said first and second movable platforms each comprise a protrusion with a plurality of holes, each protrusion being configured to allow the corresponding movable platform to be adjusted to different angles;

wherein said first and second movable platforms are connected to said bar, forming an angle between said first and second movable platforms.

9. The exercise bench of claim 8, wherein said colored indicator for indicating placement of the user's neck or lower back comprises at least one color that is different from a color of the first undulated cushion.

10. The exercise bench of claim 8, wherein the middle area of the second undulated cushion comprises a colored indicator for indicating placement of the coccyx or buttocks of the user, and the front area of the second cushion comprises a colored indicator for indicating placement of the knees or lower legs of the user.

11. The exercise bench of claim 10, wherein said colored indicator for indicating placement of the user's coccyx, buttocks, knees, or lower legs comprises at least one color that is different from a color of the second undulated cushion.

12. The exercise bench of claim 8, wherein in the top area and the bottom area of the first undulated cushion have a surface area that is greater than a surface area of the middle area.

* * * * *